US006523264B1

(12) United States Patent
Albert et al.

(10) Patent No.: US 6,523,264 B1
(45) Date of Patent: Feb. 25, 2003

(54) METHOD AND APPARATUS FOR CUTTING AN OBJECT WHILE SIMULTANEOUSLY APPLYING A BORDER TO THE OBJECT

(75) Inventors: Ross Albert, East Norwich, NY (US); Tova Friedman, Briarwood, NY (US)

(73) Assignee: The Albert Design Company, Inc., Oyster Bay, NY (US)

( * ) Notice: Subject to any disclaimer, the term of this patent is extended or adjusted under 35 U.S.C. 154(b) by 0 days.

(21) Appl. No.: 09/620,235

(22) Filed: Jul. 20, 2000

(51) Int. Cl.[7] ..... B26B 11/00

(52) U.S. Cl. ..... 30/123.3; 30/131; 30/254; 7/163

(58) Field of Search ..... 30/123, 123.3, 30/124, 131, 254, 125; 7/158, 163, 131, 135, 121

(56) References Cited

U.S. PATENT DOCUMENTS

| | | | | | |
|---|---|---|---|---|---|
| 638,662 | A | * | 12/1899 | Dow | 7/163 |
| 643,377 | A | * | 2/1900 | Janney | 7/163 |
| 1,276,433 | A | * | 8/1918 | Stainbrook et al. | 30/125 |
| 1,296,660 | A | * | 3/1919 | Hayden | 7/163 |
| 1,672,416 | A | | 6/1928 | La Clair | |
| 2,276,365 | A | | 3/1942 | Angel | |
| 2,826,859 | A | | 3/1958 | Shaffer | |
| 3,107,425 | A | | 10/1963 | Rentz | |
| 4,287,669 | A | | 9/1981 | Arai | |
| 4,783,907 | A | | 11/1988 | Ravaux | |
| 4,891,882 | A | | 1/1990 | Bloom et al. | |
| 5,531,627 | A | | 7/1996 | Deal | |
| 5,581,888 | A | | 12/1996 | Lewis | |

* cited by examiner

*Primary Examiner*—Hwei-Siu Payer
(74) *Attorney, Agent, or Firm*—Stephen E. Feldman

(57) ABSTRACT

The present invention is directed toward a method and an apparatus for cutting material, such as paper and/or fabric, while simultaneously marking the material with a decorative border. The present invention utilizes an air pump and replaceable coloring means source affixed on a cutting apparatus, such as scissors, having an air pump and replaceable coloring dispenser along the blade(s) of the scissors. The pumping mechanism utilizes check valves to regulate the flow of air through the system. In another embodiment, a colorant may be used along the blade of the scissors wherein each cut leaves a decorative border along the cut area of the material.

13 Claims, 5 Drawing Sheets

METHOD AND APPARATUS FOR CUTTING AN OBJECT WHILE SIMULTANEOUSLY APPLYING A BORDER TO THE OBJECT

FIELD OF THE INVENTION

The present invention is directed toward a method and an apparatus for cutting material, such as paper and/or fabric, while simultaneously marking the material with a decorative border. The present invention utilizes an air pump and replaceable coloring means on a cutting apparatus, such as scissors, where the air pump and the replaceable coloring means are along the blade(s) of the scissors. A colorant reservoir may be used along the blades of the scissors wherein each cut leaves a decorative border along the cut area of the material.

BACKGROUND OF THE INVENTION

There is a variety of well-known apparatus and methods for cutting materials, including scissors and shears. However, these methods and apparatus present several problems. There is a long felt need for a more effective method and apparatus for cutting materials and leaving a decorative border on a material as it is being cut.

U.S. Pat. No. 1,672,416 to LaClair discloses a roofing paper cutter in which a cutting disc turns under the influence of oil and wiping means that prevents tar from adhering to the cutting disc of the device.

U.S. Pat. No. 2,276,365 to Angel discloses a rotary cutting device having a pair of coactive rotary cutters for cutting various materials.

U.S. Pat. No. 2,826,859 to Shaffer discloses a toy knife adapted to discharge a fluid, whereby the fluid is used to simulate bleeding.

U.S. Pat. No. 3,107,425 to Rentz discloses a cutting instrument having a stylus with a moistening means. The cutting instrument is used to divide sheet material.

U.S. Pat. No. 4,287,669 to Arai discloses a glass cutter having a barrel and cutter head co-axially provided at the lower end of the barrel. The cutter head and barrel are hollow and have an oil reserve provided therein. Cutting oil is supplied to a cutting blade for cutting glass.

U.S. Pat. No. 4,783,907 to Ravaux discloses a device for simultaneously cutting and treating a plant system. This device is applicable, particularly, to pruning and treating vines, fruit trees, and other plants of the same type.

U.S. Pat. No. 4,891,882 to Bloom et al. discloses a liquid dispenser for supplying a treatment fluid to blades on a cutting implement used to cut plants. A liquid supply unit having a flow regulator is used to regulate the flow of the treatment fluid.

U.S. Pat. No. 5,531,627 to Deal discloses a cartridge-type water bomb water gun conversion device.

U.S. Pat. No. 5,581,588 to Lewis discloses a lubricated barrel pivot removably mounted in a knife handle. An oil reservoir within the barrel communicates with the bearing surface by means of an oil wick in a bore.

While the known apparatus and methods for cutting materials are of interest, they do not address the particular need to provide a decorative border on a particular material as it is being cut.

SUMMARY OF THE INVENTION

The present invention is directed toward a method and apparatus for cutting an object while simultaneously applying a decorative ink border thereto.

It is an object of the present invention to provide a scissors having a pumping apparatus for applying a decorative border to objects being cut.

It is another object to provide a scissors having a marking apparatus for applying a decorative border to objects being cut.

Other objects will become apparent from the foregoing description.

BRIEF DESCRIPTION OF THE DRAWINGS

The following description of preferred embodiments of the present invention will be better understood when read in conjunction with the appended drawings. It should be understood, however, that the invention is not limited to the precise arrangements shown in which.

DESCRIPTION OF THE PREFERRED EMBODIMENT

Figure 1:
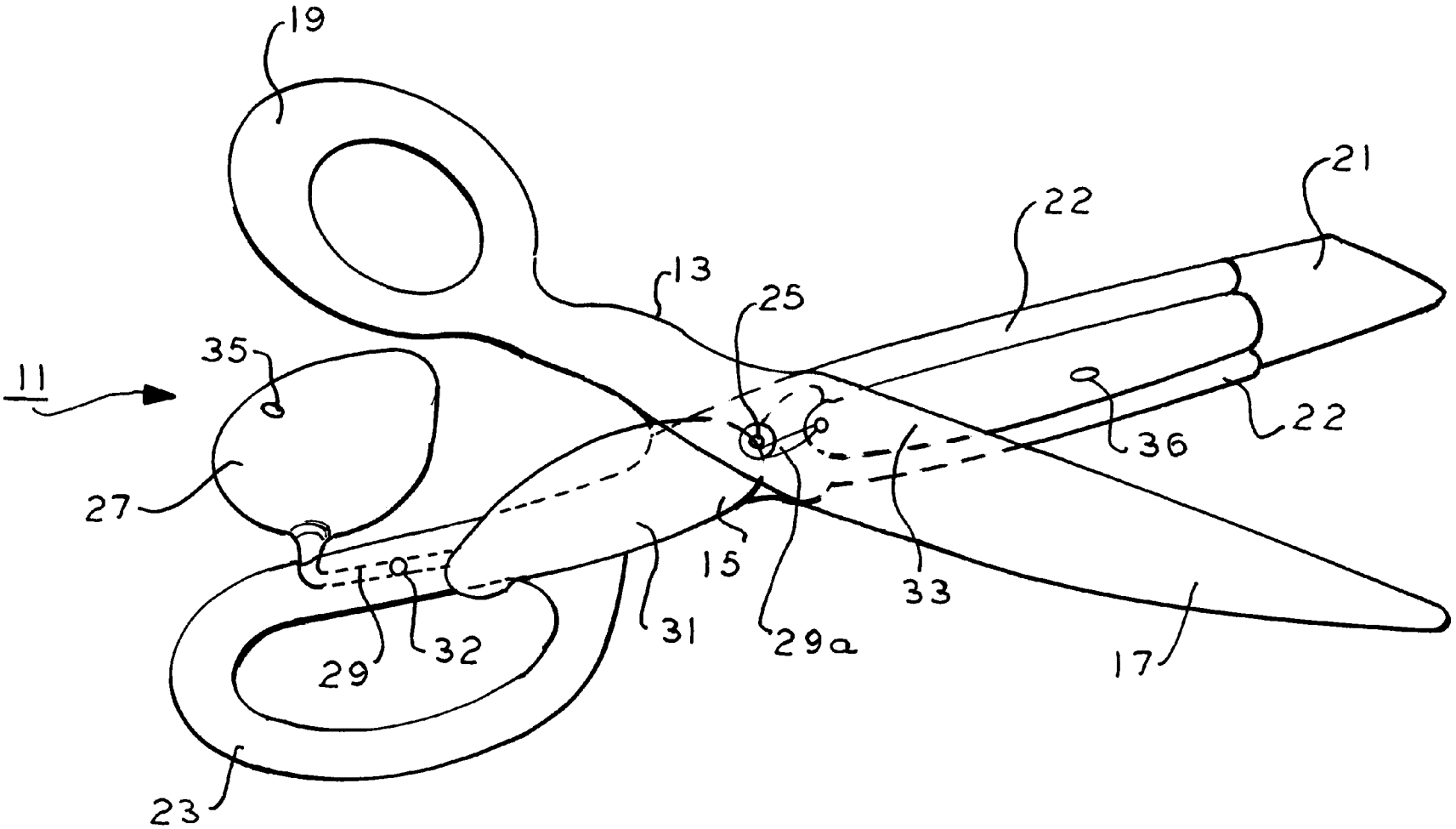
FIG. 1 is a perspective view of a scissors having a pumping apparatus for disseminating a decorative border on an object to be cut.

The present method and apparatus is of broad applicability to many technical fields for the production of an infinite variety of articles. For illustrative purposes only, a preferred mode for carrying out the inventive method will be described hereinafter in conjunction with a cutting tool, namely, a scissors having a means for distributing a colored border on an item being cut by the scissors.

Referring to FIGS. 1 through 4, a scissors 11 is implemented in conjunction with a color distribution means. Any type of scissors 11 now known or hereinafter developed may be implemented with the present invention. The scissors 11 should have a first cutting member 13 pivotably mounted to a second cutting member 15. The first cutting member 13 should have a first blade 17 and a first grasping means 19. Similarly, the second cutting member 15 should have a second blade 21 and a second grasping means 23. Preferably, the first grasping means 19 and second grasping means 23 are configured so that a cutter's finger(s) fit securely therein. The first cutting member 13 is mounted to the second cutting member 15 through the use of a pin mount 25. This method is well known for securing the cutting members of a scissors together. The first cutting member 13 and second cutting member 15 should be capable of moving between an open and closed positions for cutting material, such as paper, cloth and the like.

The color distribution means of the present invention is used for applying a decorative border to material while being cut by the scissors 11. A variety of color distribution means may be used in conjunction with a scissors. In a first embodiment, a pumping apparatus is used to create an air spray effect. In a second embodiment, a color marker is applied to the scissors 11. Each embodiment is described below.

Figure 2:
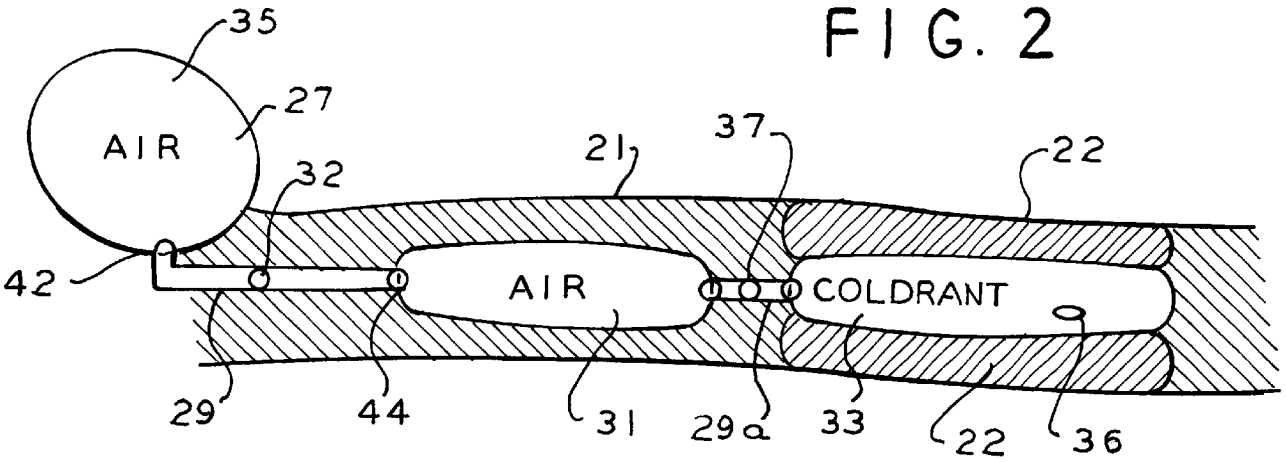
FIG. 2 is a perspective view of the pumping apparatus used with the scissors of FIG. 1.

The first embodiment of the present invention is now described. Referring to FIGS. 1 and 2, a pumping apparatus is affixed to the scissors 11. The pumping apparatus has a pressure pump 27, a first air conduit 29, an air reservoir 31, a second air conduit 29*a* and a coloring means 33. The air conduit 29 connects the pressure pump 27 to the air reservoir 31. The air reservoir 31 is connected to the coloring means 33. Air reservoirs are well known and are used for storing and maintaining a steady supply and flow of air. The coloring means 33 should have an aperture 36 for dispensing colorant onto a cutting surface. Preferably, the pressure pump 27 is a hollow bladder capable of inflating and deflating in response to pressure on the pump. The pressure pump 27 and the air reservoir 31 may be made of rubber, plastic or other materials capable of performing their respective functions. The pressure pump 27 is connected to the air reservoir 31 by the first air conduit 29. The air reservoir 31 is connected to the coloring means 33 by the second air conduit 29*a*.

Section 22 holds the reservior 33 in position and may be removable.

Figure 3:
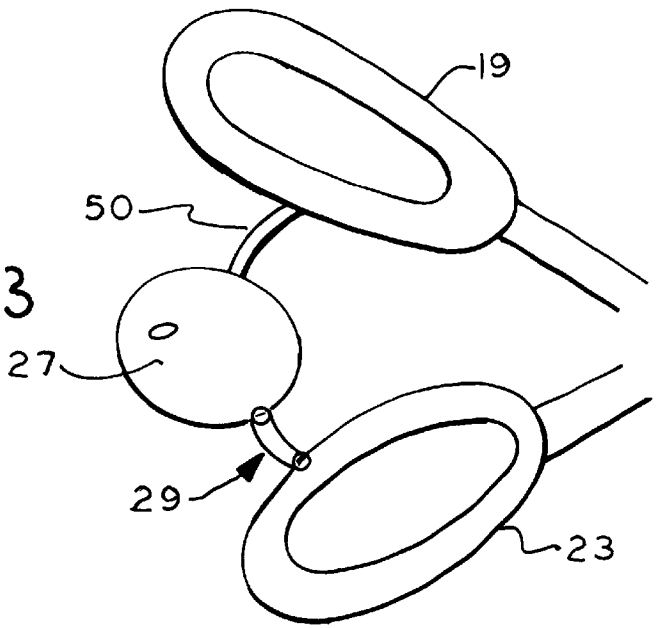
FIG. 3 is a perspective view of a scissors having a marker for discharging a decorative border on an object to be cut.

Referring to FIG. 3, the pressure pump 27 may be connected to the first grasping means 19 by a connector 50. The use of a connector 50 is preferred because it prevents the pressure pump 27 from sliding between the grasping means 19 and 23.

The pumping apparatus of the present invention operates in response to pressure applied to the system. The pumping apparatus should have inlets and outlets for receiving and discharging the air, when pressure is applied and released. Preferably, these inlets and outlets have valves to prevent unwanted intake or loss of air from the system. Accordingly, the various components of the pumping apparatus have check valves to regulate an entry and an exit of air in the pumping apparatus. The use of such check valves is described below.

The pressure pump 27 should be initially filled with air. As discussed herein, the pressure pump 27 deflates and discharges the air, when a positive pressure is applied thereto. Accordingly, the pressure pump 27 should have a one-way intake valve 35 for replenishing its air supply when deflated. When a positive pressure is released, the intake valve 35 should automatically draw air into the pressure pump 27 until its air supply is replenished. Since the intake valve 35 allows for only one-way flow of air, air may enter the pressure pump 27 through the one-way intake valve 35, but cannot escape.

Similarly, a one-way check valve 32 should be implemented to regulate the flow of air between the pressure pump 27 and the air reservoir 31. Preferably, the check valve 32 is positioned at an exit 42 of the pressure pump 27. It should be noted, however, that the check valve may be positioned within the air conduit 29 or at an entry 44 of the air reservoir 31. The check valve 32 allows air to flow from the pressure pump 27 to the air reservoir 31. Similarly, the check valve 32 prevents air from flowing from the air reservoir 31 into the pressure pump 27.

A second check valve 37 should be implemented to regulate the flow of air between the reservoir and the coloring means 33. The check valve 37 should be a one-way valve that allows air to exit the air reservoir 31 and enter the coloring means 33. Similarly, the one-way check valve 37 prevents air and/or colorant from flowing from the ink coloring means 33 into the air reservoir 31.

Figure 4:
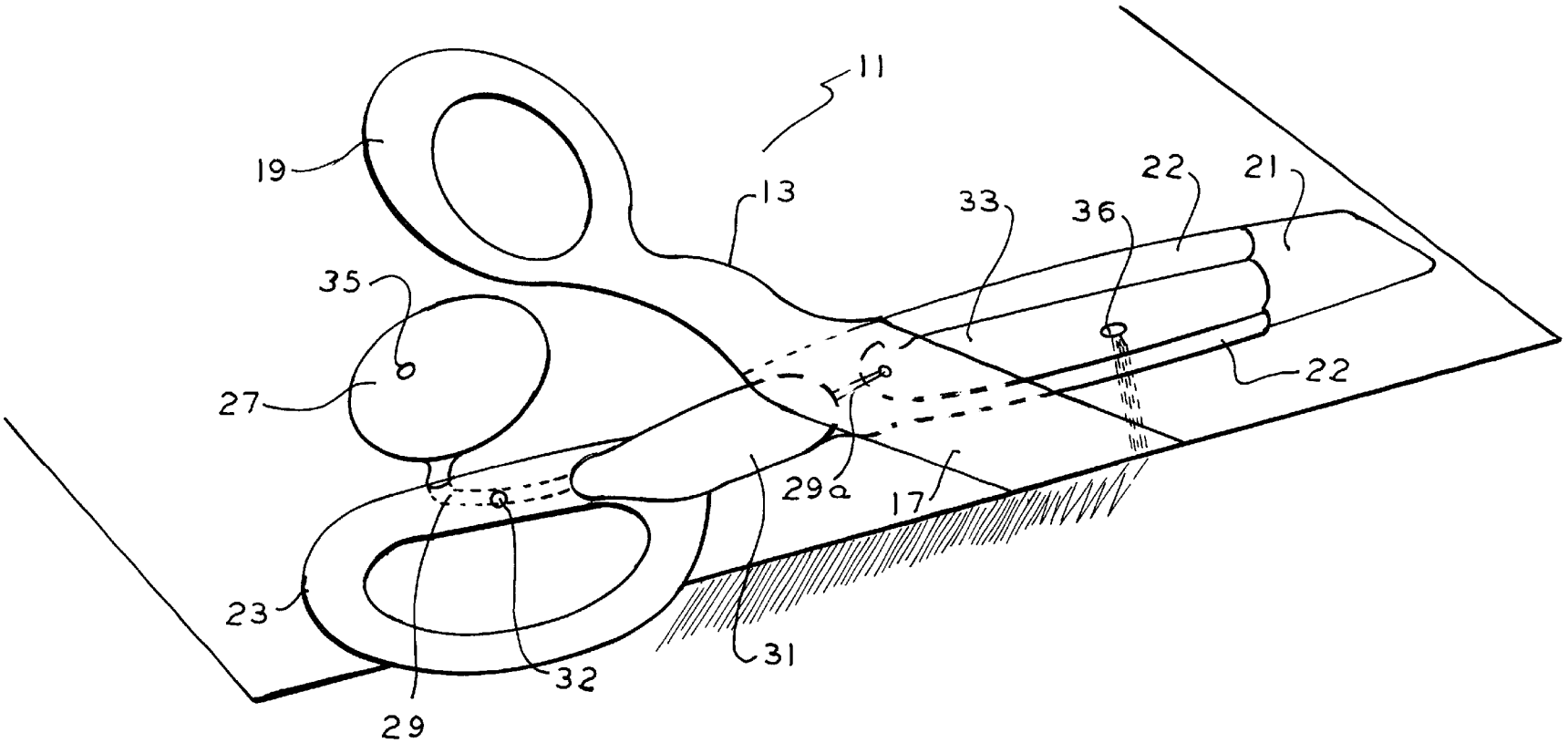
FIG. 4 is a perspective view of the scissors of FIG. 1 as used to dispense a decorative border on an object being cut.

The operation of the first embodiment of the present invention is now described with reference to FIG. 4. A person may desire to cut an object, while simultaneously marking the object with a decorative border. Prior to cutting an object, the pumping apparatus must be filled with air. To accomplish this, the pressure pump 27 should be initially filled with air and rest securely between the grasping means 19 and 23. The grasping means 19 and 23 are pressed together so that a positive pressure is applied to the pressure pump 27. As a result, the air pressure pump 27 is transferred through the air conduit 29 and into the air reservoir 31. The scissors 11 should then be moved to an open position, thereby eliminating the positive pressure. Air enters the pressure pump 27 through the one-way check valve 32. This process is repeated until the air reservoir 31 is completely filled with air.

Once the reservoir is filled with air, an object, such as paper, should be cut. Accordingly, the object is placed between blades 17 and 21. Grasping means 19 and 23 are pressed together to cut the object. As grasping means 19 and 23 are squeezed together, a positive pressure is applied to the pressure pump 27. As a result, the air flows from the pressure pump 27, through the air conduit 29 and into the reservoir 31. In turn, the air pressure causes the stagnant air in the reservoir 31 to be transferred into the coloring means 33. This air pressure causes the colorant in the coloring means 33 to be discharged through the aperture 36. As a result, a decorative border is sprayed on the cutting surface of the object as it is being cut. This process is repeated until the object is sufficiently cut with a desired border.

Figure 5:
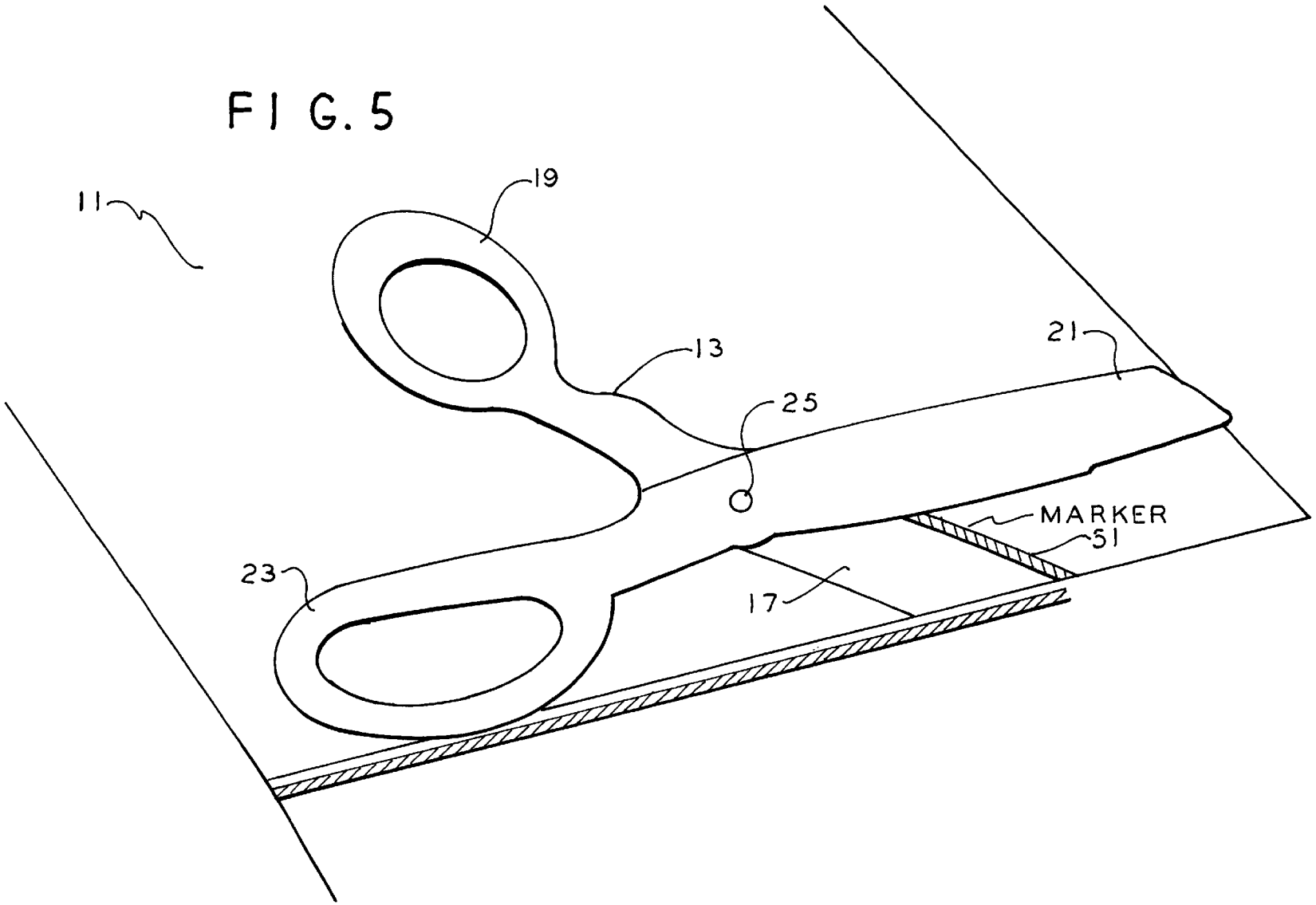
FIG. 5 is a perspective view of scissors having a marker affixed thereto for dispensing a decorative border on an object to be cut.
Figure 6:
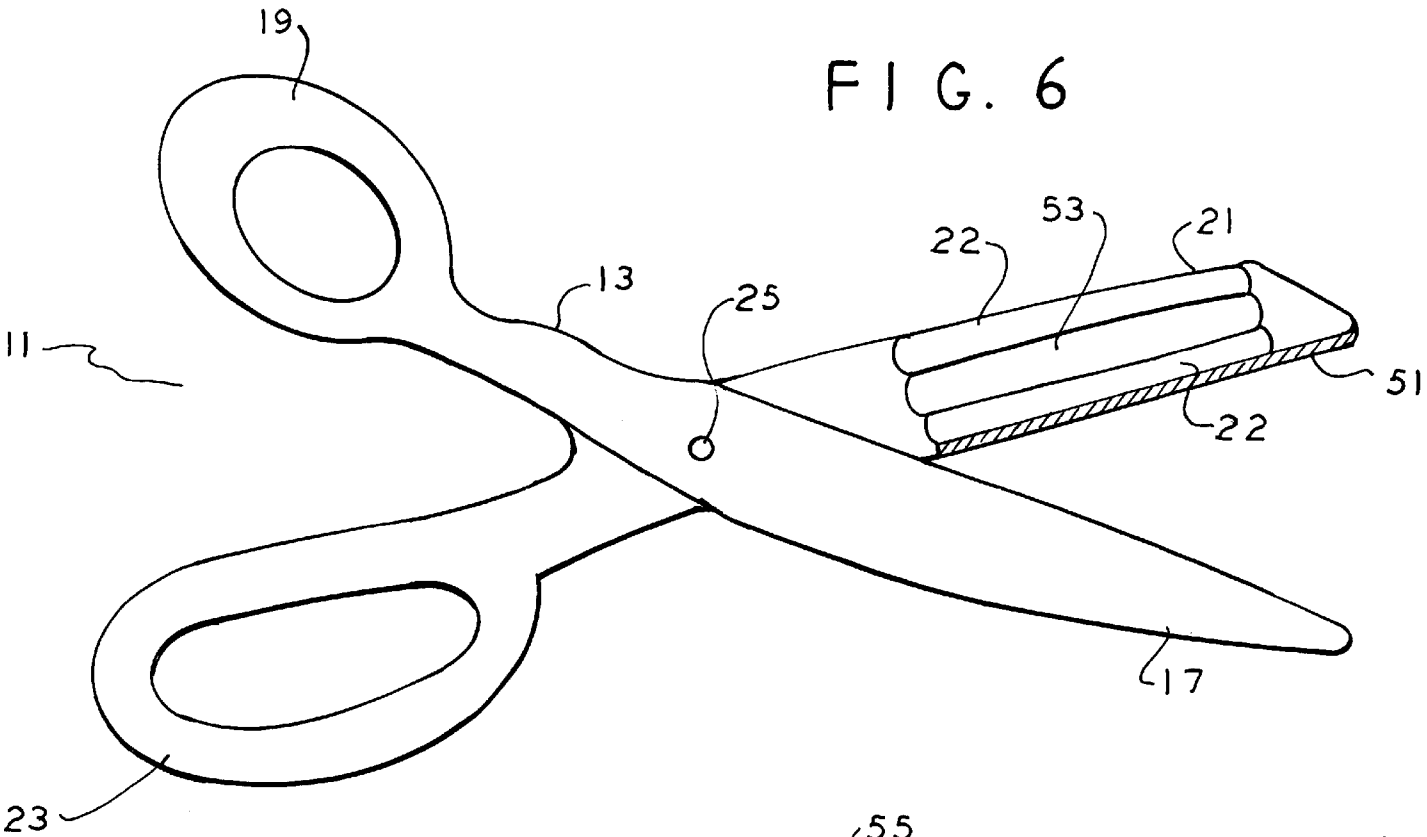
FIG. 6 is a perspective view of scissors having a marker and colorant supply affixed thereto for dispensing a decorative border on an object to be cut.
Figure 7:
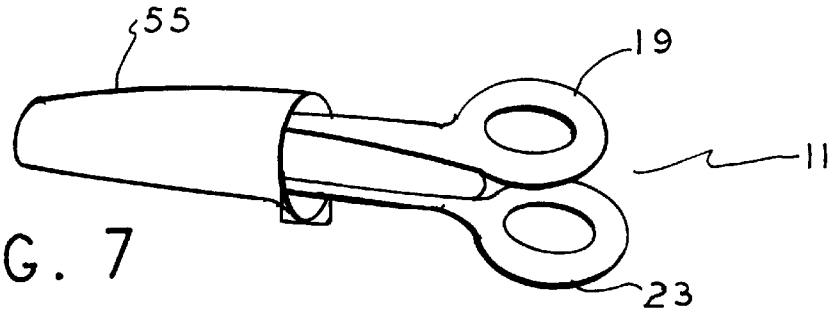
FIG. 7 is a perspective view of a case used in conjunction with the scissors of FIGS. 5 and 6.

In a second embodiment, the scissors 11 has a color marker 51 affixed to cutting blade 17 as shown in FIG. 5. It should be noted, however, that the color marker may be fixed to the cutting blade 21. The color marker may be a magic marker, a rubber ink stamp, or any other color marking means. The color marker 51 may be fixed to the cutting blade 21 through the use of glue, cement or any other adhesive. Alternatively, a colorant reservoir 53 may be affixed to cutting blade 21 as shown in FIG. 6. Referring to FIG. 7, a cover 55 should be used to store the blades 17 and 21 of the scissors. The cover 55 will prevent the color marker 51 from drying out.

The reservior may be connected to the blade by means of a tube, a moisture supply mechanism, or similar means.

The operation of the second embodiment of the present invention is now described. A person may desire to cut an object while simultaneously marking the object with a decorative border. The person should place his finger(s) in grasping means 19 and 23 and begin cutting the object. The scissors 11 is moved to an open position and the object is placed between cutting blades 17 and 21. Grasping means 19 and 23 are pressed together and the object is cut. The marker 51 contacts the cutting surface of the object and dispenses a decorative border on the edge of the object. This process is repeated until the object is sufficiently cut with a desired border.

In the foregoing description of the invention, reference to the drawings, certain terms have been used for conciseness, clarity, and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented, or described.

While the present invention has been described with reference to specific embodiments, it is understood that the invention is not so limited but rather includes any and all changes and modifications thereto which would be apparent to those skilled in the art and which come within the spirit and scope of the appended claims.

What is claimed:

1. A cutting apparatus for applying a colorant on an item being cut comprising:

a first cutting member having a first grasping member;

a second cutting member, acting with said first cutting member, having a second grasping member;

a pressure pump affixed to said first grasping member;

a reservoir connected to said pressure pump, wherein said reservoir is affixed to said first cutting member; and, a coloring means connected to said reservoir, for applying a colorant to the item to be cut.

2. The cutting apparatus of claim 1, said pressure pump further comprising:

a hollow chamber capable of inflating and deflating; and, a one-way air intake valve for receiving air in said pressure pump.

3. The cutting apparatus of claim 2, wherein said cutting apparatus is a scissor.

4. The cutting apparatus of claim 1, further comprising a first air conduit connecting said pressure pump to said reservoir;

said first air conduit having a one-way check valve for transferring air from said pressure pump to said reservoir;

a second air conduit connecting said reservoir to said coloring means;

said second air conduit having a one-way check valve for transferring air in said reservoir to said coloring means; and an aperture in said coloring means for dispensing said colorant on the item to be cut.

5. The cutting apparatus of claim 1, further comprising:

a connector for stabilizing said pressure pump, with said connector attached to said pressure pump and said second grasping member.

6. A cutting apparatus for applying a colorant on an item being cut comprising:

a first cutting member having a first grasping means including a cutting blade having a cutting edge;

a second cutting member having a second grasping means; and, a colorant near the cutting edge for applying the colorant to the item while the item is being cut by the cutting members.

7. The cutting apparatus of claim 6 further comprising a cover for housing said cutting apparatus, wherein said cover maintains moisture in said colorant.

8. The cutting apparatus of claim 6, further comprising:

a colorant chamber for storing and supplying said colorant near the edge of said blade.

9. The cutting apparatus of claim 6, wherein said cutting apparatus is a scissor and wherein the cutting members are scissor blades.

10. The cutting apparatus of claim 6 wherein said colorant being on the edge of the cutting blade.

11. The cutting apparatus of claim 10 wherein said colorant includes a pad.

12. A cutting apparatus for applying a colorant on an item being cut comprising:

a first cutting member having a first grasping means including a blade;

a second cutting member having a second grasping means;

a colorant reservoir affixed to said blade; and, a marking means along said blade in communication with the colorant reservoir.

13. The cutting apparatus of claim 12 wherein said marking means is a felt or rubber pad.

* * * * *